US010578351B1

(12) United States Patent
Nuss

(10) Patent No.: US 10,578,351 B1
(45) Date of Patent: Mar. 3, 2020

(54) REFRIGERATOR APPLIANCE WITH SOFT OPEN DRAWER FRONT

(71) Applicant: Haier US Appliance Solutions, Inc., Wilmington, DE (US)

(72) Inventor: Bart Andrew Nuss, Fisherville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/245,333

(22) Filed: Jan. 11, 2019

(51) Int. Cl.
*F25D 25/02* (2006.01)
*A47B 88/40* (2017.01)

(52) U.S. Cl.
CPC ..... *F25D 25/025* (2013.01); *A47B 88/40* (2017.01); *A47B 2210/0094* (2013.01)

(58) Field of Classification Search
CPC ..... F25D 23/028; F25D 25/025; A47B 88/60; A47B 88/944; A47B 2210/0094; A47B 2210/175
See application file for complete search history.

(56) References Cited

U.S. PATENT DOCUMENTS 2,116,370 A * 5/1938 Watkins ..... A47B 63/02 109/70
2,132,737 A * 10/1938 Kahn ..... F24C 15/18 126/340
4,149,518 A * 4/1979 Schmidt ..... F24C 15/162 126/190
5,947,573 A * 9/1999 Tovar ..... F25D 23/025 312/311
7,815,268 B2 * 10/2010 Lee ..... F25D 23/021 312/402
8,186,781 B2 5/2012 Coleman et al.
9,635,771 B2 * 4/2017 Head ..... A47B 67/04
2004/0100168 A1 * 5/2004 Choi ..... F25D 23/087 312/296
2004/0183415 A1 * 9/2004 Kim ..... F25D 25/025 312/402
2005/0127804 A1 * 6/2005 Kim ..... F25D 23/021 312/402

(Continued)

FOREIGN PATENT DOCUMENTS

CN 105972924 A 9/2016
JP H051990 U 1/1993
WO WO-2011121834 A1 * 10/2011 ..... A47B 77/16

OTHER PUBLICATIONS

English translation of CN105972924 (Year: 2019).*

*Primary Examiner* — Daniel J Rohrhoff
(74) *Attorney, Agent, or Firm* — Dority & Manning, P.A.

(57) ABSTRACT

A refrigerator appliance includes a cabinet which defines a fresh food storage chamber and a frozen food storage chamber. The refrigerator appliance also includes a drawer slidably mounted within one of the fresh food storage chamber and the frozen food storage chamber. The drawer includes a drawer body defining an interior of the drawer and a door attached to the drawer body via a hinge such that the door is rotatable relative to the drawer body between a closed position where the door encloses the interior of the drawer and an open position to provide access to the interior of the drawer. The hinge includes a damper assembly configured to dampen rotation of the door from the closed position to the open position.

17 Claims, 6 Drawing Sheets

(56) References Cited

U.S. PATENT DOCUMENTS

| | | | | |
|---|---|---|---|---|
| 2006/0049731 | A1* | 3/2006 | Choi | F25D 25/025 312/330.1 |
| 2007/0126325 | A1* | 6/2007 | Gorz | F25D 25/025 312/404 |
| 2018/0223582 | A1* | 8/2018 | Shin | F25D 23/028 |

* cited by examiner

REFRIGERATOR APPLIANCE WITH SOFT OPEN DRAWER FRONT

FIELD

The present disclosure relates generally to refrigerator appliances, and more particularly to refrigerator appliances which include at least one food storage compartment having a soft open door, in particular refrigerator appliances which include a tilt out drawer front having a soft open feature.

BACKGROUND

Refrigerator appliances generally include a cabinet that defines chilled chambers for receipt of food items for storage. One or more insulated, sealing doors are provided for selectively enclosing the chilled food storage chambers. Consumers generally prefer chilled chambers that facilitate visibility and accessibility of food items stored therein.

In certain refrigerator appliances, commonly referred to as side-by-side style refrigerator appliance, the fresh food chamber is positioned next to the freezer chamber within the cabinet. Such a configuration can permit easy access to food items stored on doors of the refrigerator appliances. However, the cabinet can be deep and narrow such that accessing food items at a back of the fresh food chamber and/or freezer chamber is difficult.

In other refrigerator appliances, the freezer chamber is positioned either above or below the fresh food chamber in the cabinet, which are commonly referred to as top mount or bottom mount refrigerator appliances. Such a configuration can provide a relatively wide fresh food chamber and/or freezer chamber, e.g., as compared to the side-by-side configuration. However, the depth of the fresh food chamber and the freezer chamber can make accessing food items at a back of the refrigerator appliance difficult.

Accordingly, a refrigerator appliance with features for assisting with accessing food items stored therein would be useful.

BRIEF DESCRIPTION

Additional aspects and advantages of the technology will be set forth in part in the following description, or may be apparent from the description, or may be learned through practice of the technology.

In accordance with one embodiment, a refrigerator appliance is provided. The refrigerator appliance includes a cabinet defining a fresh food storage chamber and a frozen food storage chamber and a drawer slidably mounted within one of the fresh food storage chamber and the frozen food storage chamber. The drawer includes a drawer body defining an interior of the drawer and a door attached to the drawer body via a hinge such that the door is rotatable relative to the drawer body between a closed position where the door encloses the interior of the drawer and an open position to provide access to the interior of the drawer. The hinge includes a damper assembly configured to dampen rotation of the door from the closed position to the open position.

In accordance with another embodiment, a drawer for a refrigerator appliance is provided. The refrigerator appliance includes a cabinet defining a fresh food storage chamber and a frozen food storage chamber. The drawer is slidably mountable within one of the fresh food storage chamber and the frozen food storage chamber. The drawer includes a drawer body defining an interior of the drawer and a door attached to the drawer body via a hinge such that the door is rotatable relative to the drawer body between a closed position where the door encloses the interior of the drawer and an open position to provide access to the interior of the drawer. The hinge includes a damper assembly configured to dampen rotation of the door from the closed position to the open position.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures.

Figure 1:
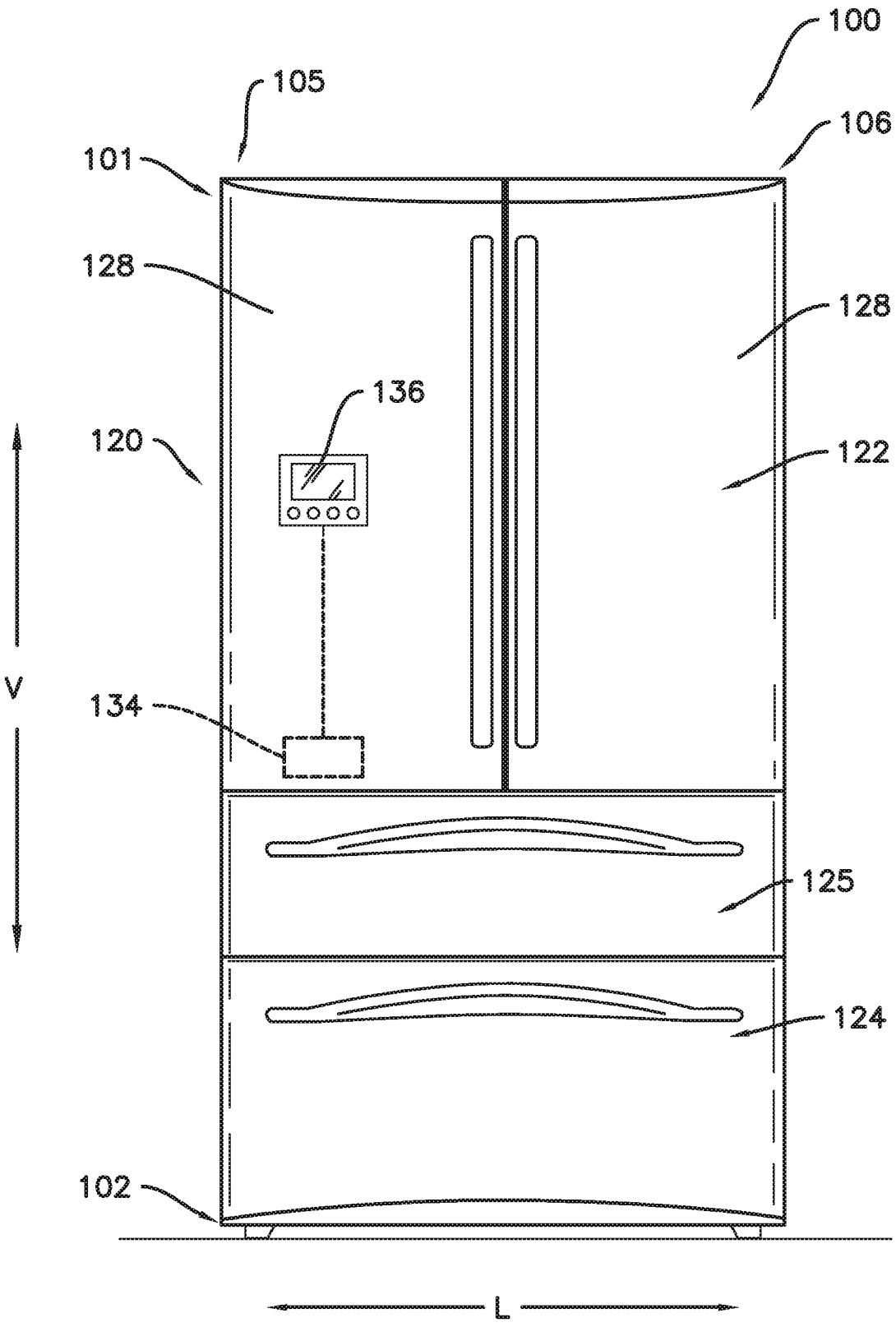
FIG. 1 provides a front view of a refrigerator appliance according to one or more exemplary embodiments of the present subject matter.

Repeat use of reference characters in the present specification and drawings is intended to represent the same or analogous features or elements of the present subject matter.

DETAILED DESCRIPTION

Reference now will be made in detail to embodiments of the technology, one or more examples of which are illustrated in the drawings. Each example is provided by way of explanation of the technology, not limitation of the technology. In fact, it will be apparent to those skilled in the art that various modifications and variations can be made in the present technology without departing from the scope or spirit of the technology. For instance, features illustrated or described as part of one embodiment can be used with another embodiment to yield a still further embodiment. Thus, it is intended that the present technology covers such modifications and variations as come within the scope of the appended claims and their equivalents.

As used herein, the terms "first," "second," and "third" may be used interchangeably to distinguish one component from another and are not intended to signify location or importance of the individual components. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees either clockwise or counterclockwise with the vertical direction V.

Figure 2:
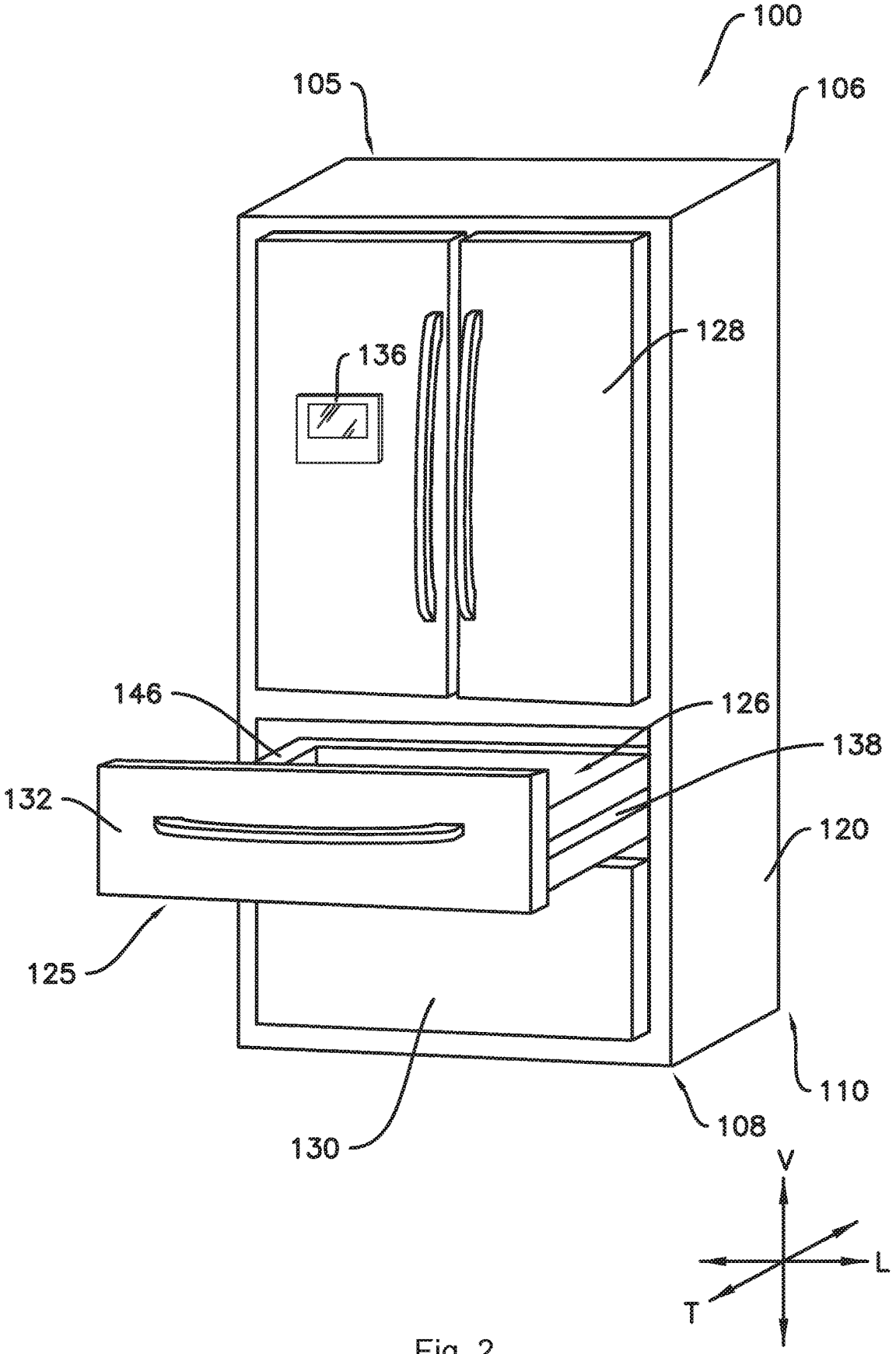
FIG. 2 provides a perspective view of the refrigerator appliance of FIG. 1 with a drawer thereof in an open position and a door of the drawer in a closed position.
Figure 3:
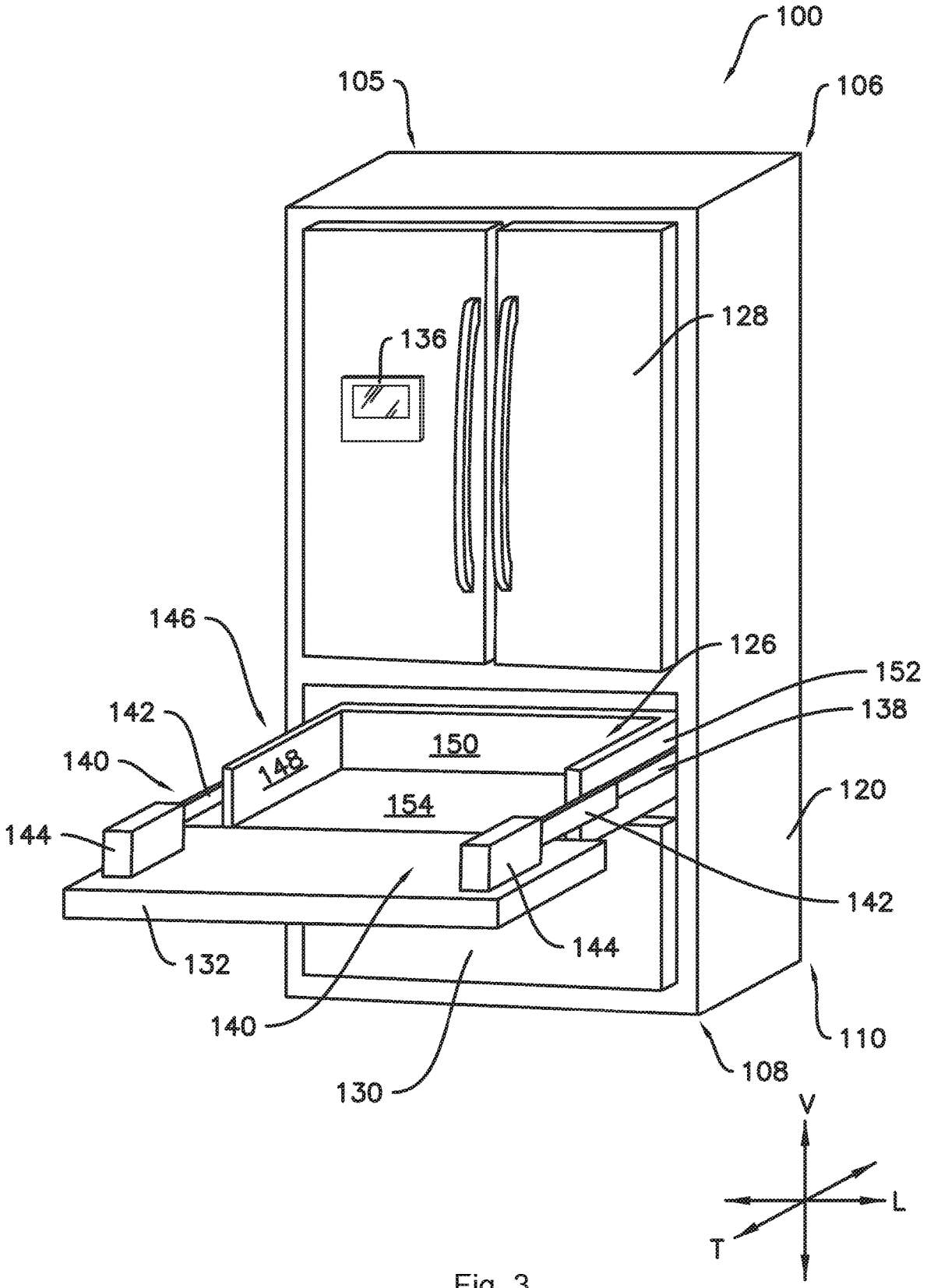
FIG. 3 provides a perspective view of the refrigerator appliance of FIG. 2 with the door of the drawer in an open position.

FIG. 1 is a front view of an exemplary embodiment of a refrigerator appliance 100. FIG. 2 is a perspective view of the refrigerator appliance 100 having a drawer 125 in an open position to reveal the interior 126 of the drawer 125. FIG. 3 is a perspective view of the refrigerator appliance 100 having a door 132 of the drawer 125 in an open position to promote access to the interior 126 of the drawer 125. Refrigerator appliance 100 extends between a top 101 and a bottom 102 along a vertical direction V. Refrigerator appliance 100 also extends between a left side 105 and a right side 106 along a lateral direction L. As shown in FIGS. 2 and 3, a transverse direction T may additionally be defined perpendicular to the vertical and lateral directions V, L. Refrigerator appliance 100 extends along the transverse direction T between a front portion 108 and a back portion 110.

Refrigerator appliance 100 includes a cabinet or housing 120 defining an upper fresh food chamber 122 and a lower freezer chamber or frozen food storage chamber 124 arranged below the fresh food chamber 122 along the vertical direction V. Because the frozen food storage chamber 124 is positioned below the fresh food storage chamber 122, refrigerator appliance 100 is generally referred to as a bottom mount refrigerator. Using the teachings disclosed herein, one of skill in the art will understand that the present technology can be used with other types of refrigerators (e.g., side-by-sides) or a freezer appliance as well. Consequently, the description set forth herein is for illustrative purposes only and is not intended to limit the technology in any aspect.

Refrigerator doors 128 are rotatably hinged to an edge of housing 120 for accessing fresh food chamber 122. It should be noted that while two doors 128 in a "French door" configuration are illustrated, any suitable arrangement of doors utilizing one, two or more doors is within the scope and spirit of the present disclosure. A freezer door 130 is arranged below refrigerator doors 128 for accessing freezer chamber 124. In the exemplary embodiment, freezer door 130 is coupled to a freezer drawer (not shown) slidably coupled within freezer chamber 124.

Operation of the refrigerator appliance 100 can be regulated by a controller 134 that is operatively coupled to a user interface panel 136. Panel 136 provides selections for user manipulation of the operation of refrigerator appliance 100 such as e.g., temperature selections. In response to user manipulation of the user interface panel 136, the controller 134 operates various components of the refrigerator appliance 100. The controller may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor.

The controller 134 may be positioned in a variety of locations throughout refrigerator appliance 100. In the illustrated embodiment, the controller 134 may be located within one of the doors 128. In such an embodiment, input/output ("I/O") signals may be routed between the controller and various operational components of refrigerator appliance 100. In one embodiment, the user interface panel 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 134 via one or more signal lines or shared communication busses.

FIGS. 2 and 3 illustrate one example embodiment of a drawer 125 for the refrigerator appliance 100. The drawer 125 may be slidably mounted within the cabinet 120, e.g., with slides 138. In the illustrated example, the drawer 125 is a freezer drawer slidably mounted within the frozen food storage chamber 124 of the refrigerator appliance 100. Accordingly, the drawer 125 may assist with storing and providing access to frozen food items. For example, smaller food items such as a bag of frozen vegetables may be stored in the freezer drawer 125 to prevent or reduce such items from being obscured under or behind larger items such as a frozen turkey, etc., as compared to when only a single portion of the refrigerator appliance 100 is provided for storing frozen items. In other embodiments, the drawer 125 may be slidably mounted within the fresh food storage chamber 122 and may provide similar advantages with respect to storing and accessing fresh food items.

As will be described in more detail below, the drawer 125 may have a tilt out drawer front with a soft open feature, e.g., the door 132 of the drawer 125 may connected to a drawer body 146 with a hinge 140 such that the door 132 is rotatable relative to the drawer body 146. Further, the hinge 140 may include a damper assembly 144 which dampens rotation of the door 132 at least from a closed position (FIG. 2) to an open position (FIG. 3) to provide the soft open feature. In some embodiments, the damper assembly 144 may dampen rotation in both directions between the open and closed positions.

As best seen in FIG. 3, the drawer 125 may include a drawer body 146 which includes a left wall 148, a back wall 150, a right wall 152, and a floor 154. The drawer body 146 at least partially defines an interior 126 of the drawer 125 which may provide a storage volume, e.g., for food items. To promote accessibility of such food items which may be stored within the interior 126 of the drawer 125, the door 132 of the drawer 125 may be rotatable relative to the drawer body 146, to an open position as shown in FIG. 3. The door 132 may be rotatable relative to the drawer body 146 in that the door 132 may be connected to the drawer body 146 by one or more hinges 140.

Figure 4:
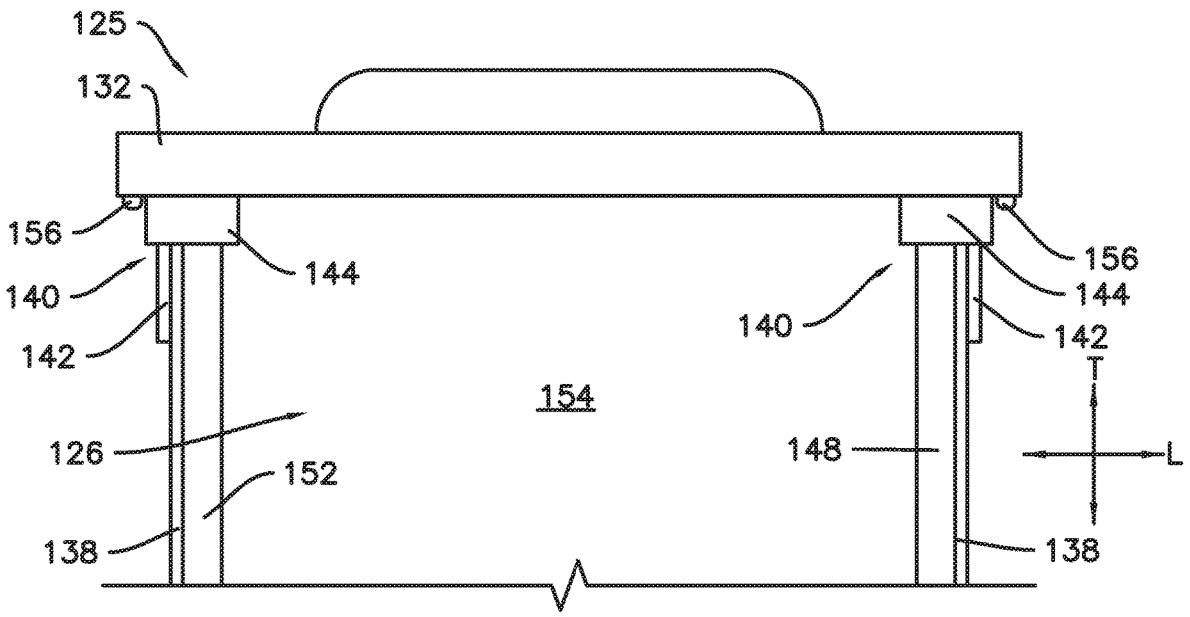
FIG. 4 provides a partial overhead view of the drawer of FIGS. 2 and 3.

For example, as shown in FIG. 4, the door 132 may be connected to the drawer body 146 by a pair of hinges 140, such as a left hinge 140 connected to the left side wall 148 of the drawer body 146 by a pivot arm 142 of the left hinge 140 and a right hinge 140 connected to the right side wall 152 of the drawer body 146 by a pivot arm 142 of the right hinge 140. In some embodiments, the drawer 125 may be slidably mounted within the cabinet 120, e.g., within one of the fresh food storage 122 chamber and the frozen food storage chamber 124, by a left slide 138 on the left side wall 148 and a right slide 138 on the right side wall 152, such that the drawer 125 can slide between the closed position of the drawer 125 (FIG. 1) and the open position of the drawer 125 (FIGS. 2 and 3). Additionally one or more gaskets 156 (FIG. 4) may be provided on the door 132 of the drawer 125 to sealingly engage the cabinet 120 when the drawer 125 is in the closed position. As shown in FIG. 4, the pivot arms 142 of the hinges 140 may each be connected to a corresponding slide 138 at each side wall of the drawer body 146. The hinge 140, or each hinge 140 in the pair of hinges 140, may include a damper assembly 144 configured to dampen rotation of the door 132 from the closed position (FIG. 2) to the open position (FIG. 3).

Figure 5:
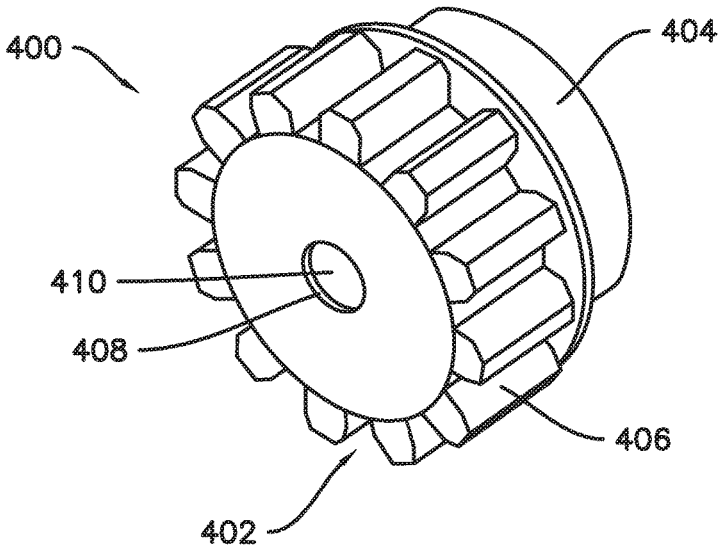
FIG. 5 provides a perspective view of an exemplary rotary damper which may be incorporated into one or more exemplary embodiments of the present subject matter.

Turning now to FIG. 5, an example rotary damper 400 is illustrated, which may be incorporated into the damper assembly 144. The rotary damper 400 may be a clockwise rotary damper which dampens clockwise rotation, a counterclockwise rotary damper which dampens counterclockwise rotation, or may dampen rotation in both directions. As shown in the FIG. 5, the rotary damper 400 includes a gear 402 having a plurality of gear teeth 406 and a reservoir 404 containing damping fluid. The reservoir 404 may sealingly retain a damping fluid. Providing damping fluid within reservoir 404 may impede rotation of the door 132 relative to the drawer body 146 to avoid or minimize the door 132 falling open. For example, the reservoir of damping fluid 404 may provide a damping force countering the weight of the door 132 and the resultant tendency of the door 132 to rotate suddenly into the open position due to the force of gravity. The gear 402 may be mounted on the reservoir 404 by an axle 410 extending into a central aperture 408 of the gear 402.

Figure 6:
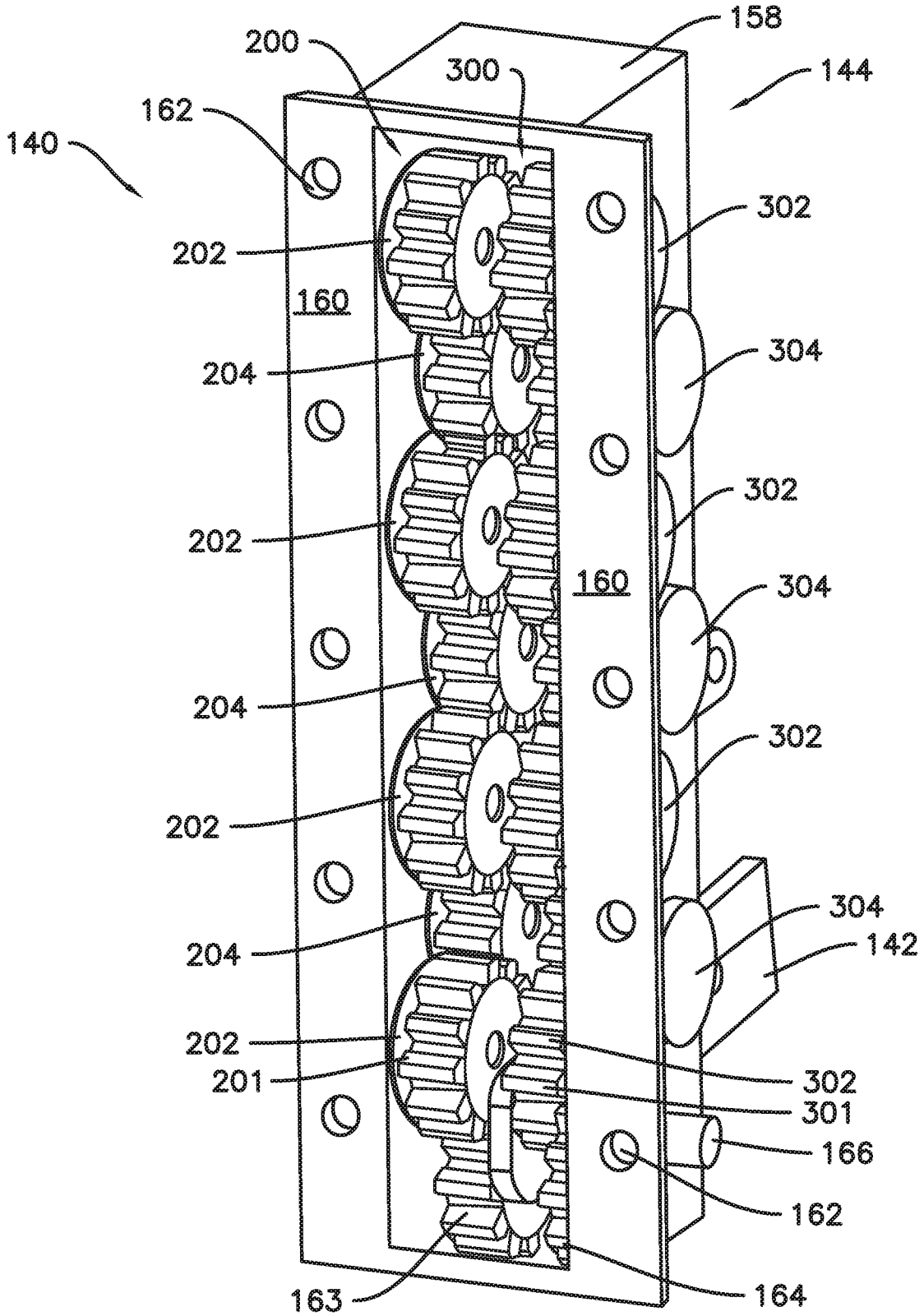
FIG. 6 provides a perspective view of an exemplary hinge which may be incorporated into one or more exemplary embodiments of the present subject matter.
Figure 7:
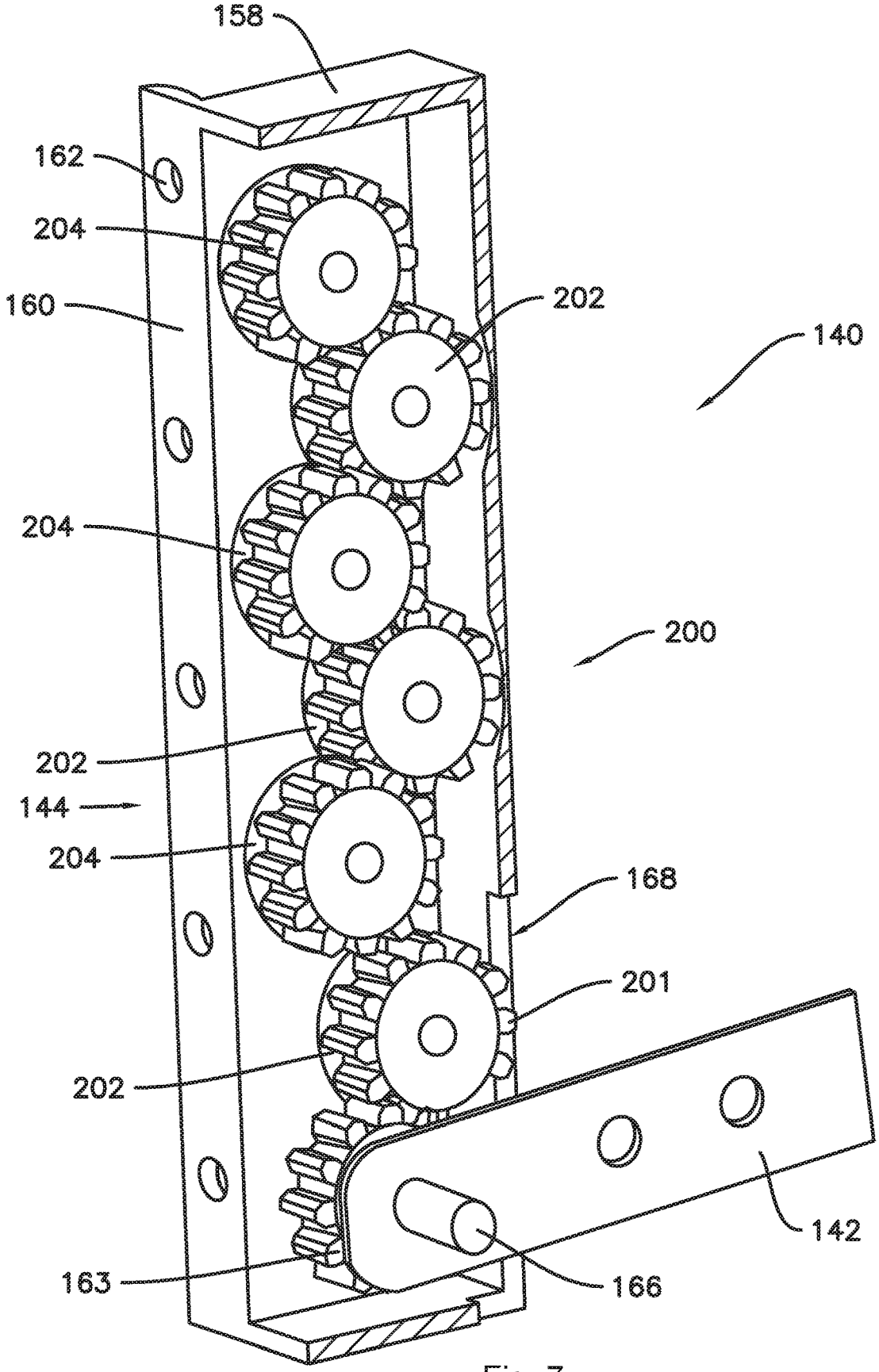
FIG. 7 provides a section view of the hinge of FIG. 6.

Referring now to FIGS. 6 and 7, the damper assembly 144 may include a housing 158 with rotary dampers mounted therein, such as a plurality of the rotary damper 400 illustrated in FIG. 5. The housing 158 may include a mounting flange 160 with a plurality of apertures 162 provided therein. The apertures 162 may receive fasteners, e.g., bolts, which may be used to secure the damper assembly 144 to the door 132.

In some embodiments, the damper assembly 144 may include a first plurality of serially connected rotary dampers 200 and a second plurality of serially connected rotary dampers 300. The first plurality of serially connected rotary dampers 200 may include a plurality of counterclockwise rotary dampers 202 and a plurality of clockwise rotary dampers 204. As shown in FIGS. 6 and 7, each counterclockwise rotary damper 202 of the plurality of counterclockwise rotary dampers 202 may be adjacent to and engaged with at least one clockwise rotary damper 204 of the plurality of clockwise rotary dampers 204. Similarly to the first plurality of serially connected rotary dampers 200, the second plurality of serially connected rotary dampers 300 may include a plurality of counterclockwise rotary dampers 302 and a plurality of clockwise rotary dampers 304. As shown in FIG. 6, each counterclockwise rotary damper 302 of the plurality of counterclockwise rotary dampers 302 may be adjacent to and engaged with at least one clockwise rotary damper 304 of the plurality of clockwise rotary dampers 304.

As best seen in FIG. 6, the second plurality of serially connected rotary dampers 300 may be connected to the first plurality of serially connected rotary dampers 200 by a shaft 166. For example, the shaft 166 may extend though the pivot arm 142 of the hinge 140, with a first fixed gear 163 and a second fixed gear 164 fixed to the shaft 166 and the pivot arm 142 on each side of the pivot arm 142. The first fixed gear 163 may be adjacent to and engaged with a first rotary damper 201 of the first plurality of serially connected rotary dampers 200. The second fixed gear 164 may be adjacent to and engaged with a first rotary damper 301 of the second plurality of serially connected rotary dampers 300. As may be seen in FIG. 7, the housing 158 of the damper assembly 144 may include a slot 168 therein which provides a clearance space for the pivot arm 142 to accommodate relative movement, e.g., rotation, between the pivot arm 142 and the housing 158.

As is generally understood, the rotation of a gear in a first direction, e.g., in the clockwise direction, causes an adjacent gear to rotate in an opposite direction, e.g., in the counterclockwise direction, when the teeth of the gears are interengaged. In the illustrated example embodiments, when the door 132 and the housing 158 (which may be attached to the door 132 as mentioned above) rotate relative to the drawer body 146 and the pivot arm 142 (which may be attached to the drawer body 146 as mentioned above) to the open position of the door 132, the gear(s) of the first rotary damper(s) 201 and 301 will revolve around the respective fixed gear(s) 163 and/or 164 while rotating in a counterclockwise direction. Thus, arranging the pluralities of rotary dampers 200 and 300 such that the counterclockwise rotary dampers 202 and 302 alternate with the clockwise rotary dampers 204 and 304 as described provides a collective damping force against a single direction of rotation of the door 132, e.g., to the open position. In other embodiments, the first and second pluralities of rotary dampers 200 and 300 may include rotary dampers which dampen rotation in both directions as well as or instead of the counterclockwise and clockwise rotary dampers 202, 302, 204, and 304.

The plurality or pluralities of serially connected rotary dampers collectively provide sufficient damping force to counteract the weight of the door 132 and prevent or reduce the door 132 falling open, providing a soft open feature to the tilt out drawer front. Moreover, where the damping force is provided by a plurality of dampers arranged and configured as shown and described herein, an equivalent damping force of a larger damper may be provided in a smaller, more compact footprint. Accordingly, the usable space within the interior 126 of the drawer 125 may be maximized. Additionally, including multiple rotary dampers provides redundancy. For example, if one rotary damper of the plurality of serially connected rotary dampers fails, the overall damping force is reduced only slightly, e.g., as compared to a damping assembly which includes only a single damper.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet defining a fresh food storage chamber and a frozen food storage chamber;

a drawer slidably mounted within one of the fresh food storage chamber and the frozen food storage chamber, the drawer comprising a drawer body defining an interior of the drawer and a door attached to the drawer body via a hinge whereby the door is rotatable relative to the drawer body between a closed position where the door encloses the interior of the drawer and an open position to provide access to the interior of the drawer, the hinge comprising a damper assembly configured to dampen rotation of the door from the closed position to the open position;

wherein the damper assembly comprises a plurality of serially connected rotary dampers, the plurality of serially connected rotary dampers comprising a plurality of counterclockwise rotary dampers and a plurality of clockwise rotary dampers, wherein each counterclockwise rotary damper of the plurality of counterclockwise rotary dampers is adjacent to and engaged with at least one clockwise rotary damper of the plurality of clockwise rotary dampers.

2. The refrigerator appliance of claim 1, wherein the plurality of serially connected rotary dampers is a first plurality of serially connected rotary dampers, and the damper assembly further comprises a second plurality of serially connected rotary dampers connected to the first plurality of serially connected rotary dampers by a shaft.

3. The refrigerator appliance of claim 2, wherein the shaft extends through a pivot arm of the hinge.

4. The refrigerator appliance of claim 3, wherein the damper assembly comprises a first fixed gear adjacent to and engaged with a first rotary damper of the first plurality of serially connected rotary dampers and a second fixed gear adjacent to and engaged with a first rotary damper of the second plurality of serially connected rotary dampers.

5. The refrigerator appliance of claim 4, wherein the first fixed gear and the second fixed gear are fixed to the pivot arm by the shaft.

6. The refrigerator appliance of claim 1, wherein the damper assembly comprises a fixed gear adjacent to and engaged with a first rotary damper of the plurality of serially connected rotary dampers.

7. The refrigerator appliance of claim 6, wherein the fixed gear of the damper assembly is fixed to a pivot arm of the hinge.

8. The refrigerator appliance of claim 1, wherein each rotary damper of the plurality of serially connected rotary dampers comprises a gear and a reservoir containing damping fluid, the gear mounted on the reservoir by an axle extending into a central aperture of the gear.

9. The refrigerator appliance of claim 1, wherein the drawer body comprises a left side wall and a right side wall and the drawer is slidably mounted within the one of the fresh food storage chamber and the frozen food storage chamber by a left slide on the left side wall and a right slide on the right side wall, wherein the hinge is one of a pair of hinges comprising a left hinge connected to the left side wall of the drawer body by a pivot arm of the left hinge and a right hinge connected to the right side wall of the drawer body by a pivot arm of the right hinge.

10. The refrigerator appliance of claim 1, wherein the drawer is slidably mounted within the frozen food storage chamber.

11. A drawer for a refrigerator appliance, the refrigerator appliance comprising a cabinet defining a fresh food storage chamber and a frozen food storage chamber, the drawer configured for slidably mounting within one of the fresh food storage chamber and the frozen food storage chamber, the drawer comprising:

a drawer body defining an interior of the drawer; and a door attached to the drawer body via a hinge whereby the door is rotatable relative to the drawer body between a closed position where the door encloses the interior of the drawer and an open position to provide access to the interior of the drawer;

wherein the hinge comprises a damper assembly configured to dampen rotation of the door from the closed position to the open position;

wherein the damper assembly comprises a plurality of serially connected rotary dampers, the plurality of serially connected rotary dampers comprising a plurality of counterclockwise rotary dampers and a plurality of clockwise rotary dampers, wherein each counterclockwise rotary damper of the plurality of counterclockwise rotary dampers is adjacent to and engaged with at least one clockwise rotary damper of the plurality of clockwise rotary dampers.

12. The drawer for a refrigerator appliance of claim 11, wherein the plurality of serially connected rotary dampers is a first plurality of serially connected rotary dampers, and the damper assembly further comprises a second plurality of serially connected rotary dampers connected to the first plurality of serially connected rotary dampers by a shaft.

13. The drawer for a refrigerator appliance of claim 12, wherein the shaft extends through a pivot arm of the hinge.

14. The drawer for a refrigerator appliance of claim 13, wherein the damper assembly comprises a first fixed gear adjacent to and engaged with a first rotary damper of the first plurality of serially connected rotary dampers and a second fixed gear adjacent to and engaged with a first rotary damper of the second plurality of serially connected rotary dampers.

15. The drawer for a refrigerator appliance of claim 14, wherein the first fixed gear and the second fixed gear are fixed to the pivot arm by the shaft.

16. The drawer for a refrigerator appliance of claim 11, wherein the damper assembly comprises a fixed gear adjacent to and engaged with a first rotary damper of the plurality of serially connected rotary dampers.

17. The drawer for a refrigerator appliance of claim 16, wherein the fixed gear of the damper assembly is fixed to a pivot arm of the hinge.

* * * * *